US005548378A

United States Patent [19]

Ogata et al.

[11] Patent Number: 5,548,378

[45] Date of Patent: Aug. 20, 1996

[54] IMAGE OPERATING APPARATUS PROVIDING IMAGE STABILIZATION CONTROL

[75] Inventors: Takao Ogata, Yokohama; Koji Amemiya, Tokyo; Tatsuo Takeuchi, Kawasaki; Takashi Hasegawa, Ageo; Rie Saito, Yokohama; Nobuatsu Sasanuma, Yamato, all of Japan

[73] Assignee: Canon Kabushiki Kaisha, Tokyo, Japan

[21] Appl. No.: 173,462

[22] Filed: Dec. 27, 1993

Related U.S. Application Data

[63] Continuation of Ser. No. 836,908, Feb. 19, 1992, abandoned.

[30] Foreign Application Priority Data

Feb. 22, 1991 [JP] Japan ..... 3-028636

[51] Int. Cl.[6] ..... G03G 15/00

[52] U.S. Cl. ..... 355/208; 355/246; 355/285

[58] Field of Search ..... 355/208, 214, 355/246, 308, 216, 219, 203, 206, 285; 358/300, 518

[56] References Cited

U.S. PATENT DOCUMENTS

| | | | |
|---|---|---|---|
| 4,592,646 | 6/1986 | Suzuki et al. | 355/14 |
| 4,888,636 | 12/1989 | Abe | 358/80 |
| 5,057,867 | 10/1991 | Ishigaki et al. | 355/208 |
| 5,317,367 | 5/1994 | Pierce et al. | 355/203 |

FOREIGN PATENT DOCUMENTS

| | | |
|---|---|---|
| 0159570 | 10/1985 | European Pat. Off. . |
| 0284307 | 9/1988 | European Pat. Off. . |
| 0411865 | 2/1991 | European Pat. Off. . |
| 2-97971 | 4/1990 | Japan . |

*Primary Examiner*—Joan H. Pendegrass
*Attorney, Agent, or Firm*—Fitzpatrick, Cella, Harper & Scinto

[57] ABSTRACT

An image forming apparatus comprises: an image forming unit to form an image onto a recording medium; a measuring unit to measure a density of the image formed on the recording medium; a controller to execute an image stabilizing control to decide image forming conditions of the image forming unit on the basis of the image density measured by the measuring unit; a heater to heat a load by supplying a current to the image forming apparatus; and a detector to detect a temperature of the load which is heated by the heater, wherein the controller controls the execution of the image stabilizing control in accordance with an output of the detector at the start of the power supply to the apparatus. When the detected temperature of the load is less than a predetermined value, the image stabilizing control is executed. When it is equal to or higher than the predetermined value, the image stabilizing control is not performed. When the image stabilizing control is executed, the control means allows the image forming unit to form a sample image and the image forming conditions are controlled on the basis of the state of the sample image.

35 Claims, 14 Drawing Sheets

LUT
25
8
26
27
LASER DRIVER
28
29
30
D/A
D/A
D/A
I/O
8
8
8
CPU
33
MEMORY
34
DISPLAY UNIT
35
FIXING ROLLER TEMPERATURE DETECTION CIRCUIT
50
HEATER DRIVING CIRCUIT
52
51
I/O
8
8
A/D
A/D
31
32
3a
LASER UNIT
3b
36
1
5
4
4M
4C
4K
4Y
11a
11b

IMAGE OPERATING APPARATUS PROVIDING IMAGE STABILIZATION CONTROL

This application is a continuation of application Ser. No. 07/836,908, filed Feb. 19, 1992, now abandoned.

BACKGROUND OF THE INVENTION

1. Field of the Invention

The invention relates to an image forming apparatus for forming a sample image onto a recording medium and for controlling image forming conditions on the basis of a state of the sample image.

2. Related Background Art

In recent years, in U.S. Pat. No. 4,888,636, U.S. Ser. No. 760505, now U.S. Pat. No. 5,406,390, and the like, there have been proposed several control methods whereby in order to stabilize an image density which is generated in a full-color copying apparatus, a specific pattern is formed on an image carrier and an optical density of the pattern is read and fed back to a toner supplemental amount and image forming conditions.

In the case of actually applying such image stabilizing controls, there is a method of manually actuating such a control by the user or service person or a method of automatically actuating such a control. It is considered that the automatic actuating method is preferable when considering from the side of the user of the apparatus.

In the foregoing U.S. Pat. No. 4,888,636, since the feedback control is actuated by the service person, there is a drawback such that in the case where an image deterioration occurs, a proper image cannot be obtained until the service person comes.

According to the foregoing U.S. Ser. No. 760505, when a power switch is turned on or after the elapse of a predetermined time from the turn-on of the power switch, the feedback control is automatically executed.

However, when the feedback control (image stabilizing control) is actuated at the time of turn-off/on of the power source of the image forming apparatus, feedback control is also actuated even at the time of a recovery of a simple error which is recovered by the on/off operation of the power source, so that it takes a time to recover the machine. There is a possibility such that the copying operation of the user is remarkably obstructed.

Since the image stabilizing control operation requires a long time, therefore, in the case of automatically actuating such a control, it is an important point at which stage of the machine which is used the control is actuated in order to improve the convenience for the user.

SUMMARY OF THE INVENTION

It is an object of the invention to provide an image forming apparatus which can solve the foregoing drawbacks.

Another object of the invention is to provide an image forming apparatus in which by controlling the actuation of the image stabilizing control operation in accordance with a temperature of a load to which a current is supplied from the turn-on of a power source of the image forming apparatus, the obstruction of the start of the ordinary image forming operation is prevented as possible.

Still another object of the invention is to provide an image forming apparatus in which when a temperature of a fixing unit is lower than a predetermined temperature at the time of turn-on of a power source, the image stabilizing control operation is executed, and when the temperature of the fixing unit is higher than the predetermined temperature, the image stabilizing control operation is not executed, thereby preventing that the image stabilizing control operation is vainly executed, so that an image can be smoothly formed.

The above and other objects and features of the present invention will become apparent from the following detailed description and the appended claims with reference to the accompanying drawings.

DETAILED DESCRIPTION OF THE PREFERRED EMBODIMENTS

An embodiment of the invention will be described in detail hereinbelow with reference to the drawings.

Figure 1:
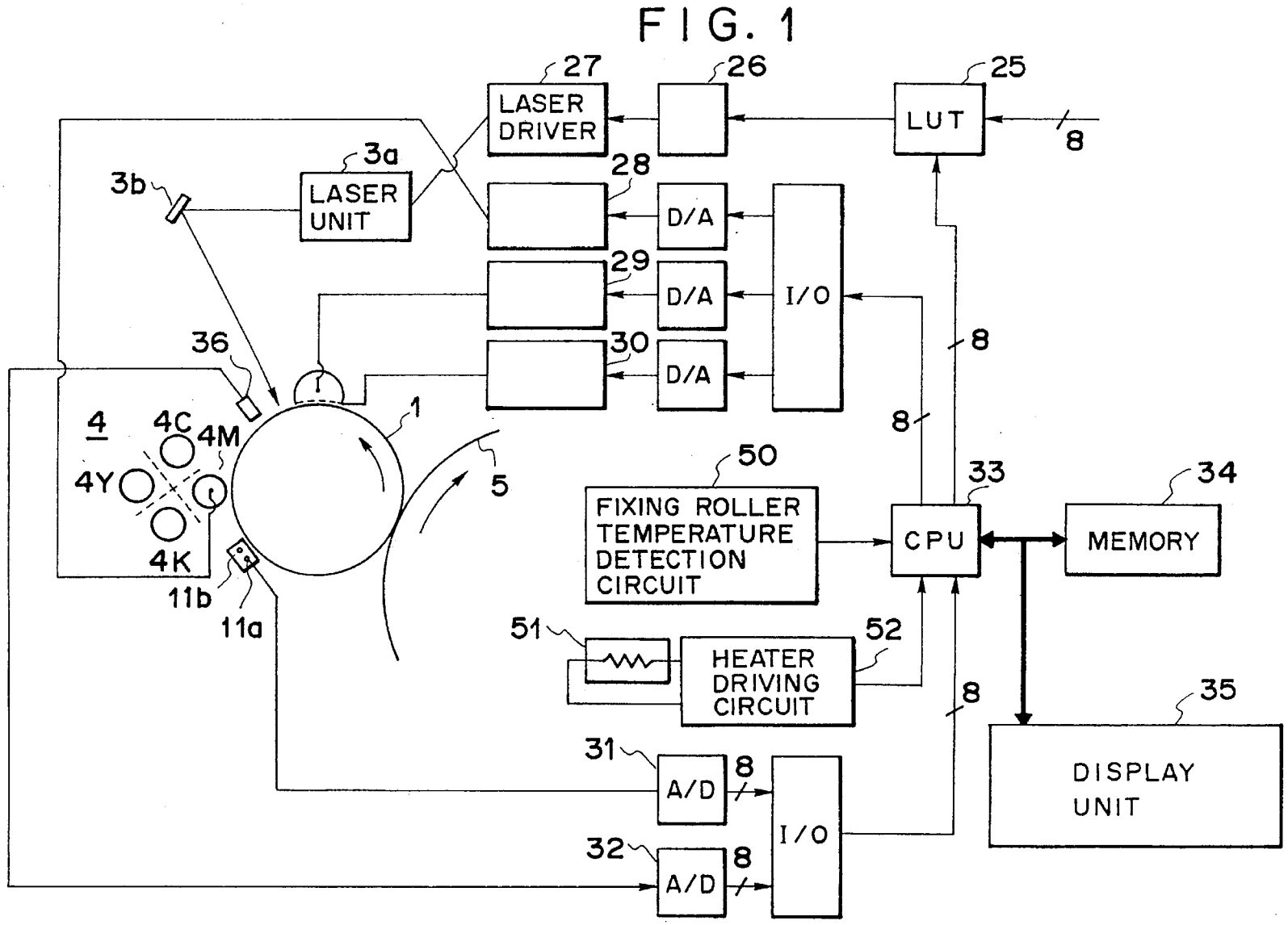
FIG. 1 is a diagram showing an embodiment of the invention.

FIG. 1 shows a control block diagram of an image forming apparatus to which the invention can be applied. In the embodiment, an image signal generated from an image reader or a host computer (not shown) is converted into a laser beam through a laser unit 3*a* comprising a laser driver, a laser light source, and a polygon mirror. The laser beam is reflected by a mirror 3*b* and is irradiated onto a photosensitive drum 1 which has been primary-charged. A latent image is formed on the drum 1 by the scan of a laser beam. The drum 1 rotates in the direction indicated by an arrow shown in the diagram, so that the image on the drum is developed by a toner every color by a rotary developing unit 4.

A copy transfer paper is wound around a copy transfer drum 5. The drum 5 rotates once at a time in accordance with the developing order of Y (yellow), M (magenta), C (cyan), and Bk (black). When the drum 5 rotates total four times, one copy transfer operation is completed.

After completion of the copy transfer operation, the copy transfer paper is removed away from the drum 5 and fixed by a pair of fixing rollers, thereby completing a color image print. Since such a color image forming method as mentioned above is well-known technique as disclosed in U.S. Pat. No. 4,873,570 or the like, its detailed description is omitted here.

Reference numeral 11*a* denotes an LED as irradiating means for emitting near infrared rays (having a main wavelength at about 960 nm) and 11*b* indicates a photosensitive device to receive the near infrared rays from the photosensitive drum 1. The photosensitive device 11*b* is used to read a patch pattern, which will be explained in detail hereinlater.

Reference numeral 50 denotes a detection unit to detect a temperature of the fixing roller; 51 a heater to heat the fixing rollers; and 52 a driving circuit of the heater 51.

Figure 2:
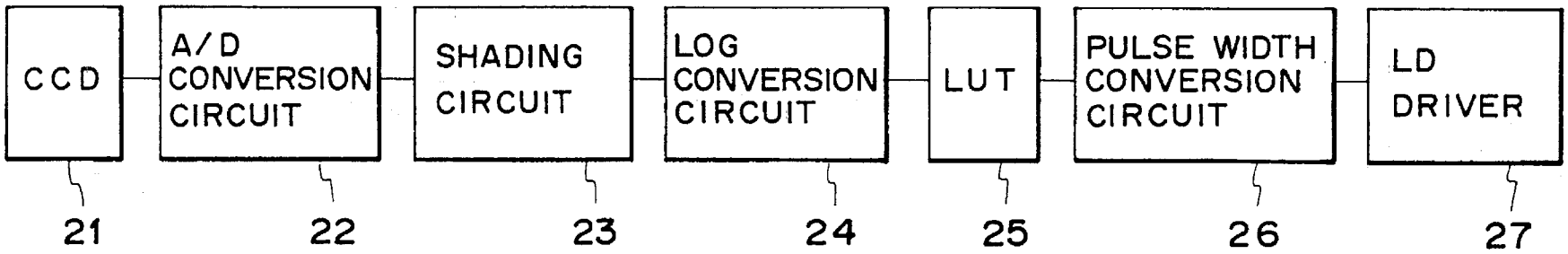
FIG. 2 is a block diagram showing a processing circuit for processing an electric signal from a CCD.

FIG. 2 shows an image signal processing circuit to obtain a gradation image according to the embodiment.

A luminance signal of the image is obtained by a CCD 21 of the image reader and converted into a digital luminance signal by an A/D conversion circuit 22.

A variation in sensitivities of elements of the CCD 21 for the obtained luminance signal is corrected by a shading circuit 23. The corrected luminance signal is converted into a density signal by LOG conversion circuit 24. The obtained density signal is converted by an LUT 25 so that the original image density coincides with the output image density with respect to the y characteristics of a printer upon initial setting. The LUT 25 executes the correction by using a correction table which is formed by the results of arithmetic operations, which will be explained hereinbelow. After the density signal was converted by the LUT 25, the signal is converted into the signal corresponding to a dot width by a pulse width conversion circuit 26 and sent to a laser driver 27. A latent image having the gradation characteristics by a change in dot area is formed onto the photosensitive drum 1 by the laser scan and is subjected to developing, copy transferring, and fixing processes, so that a high gradation image is derived.

The above image forming apparatus has therein a pattern generator to generate a test pattern which is formed on the photosensitive drum 1.

A specific pattern is formed on the image carrier and measured by the sensor 11*b* of the LED 11*a* at a proper timing. By deciding a toner supplementary amount on the basis of a deviation amount between the measured near infrared ray quantity and a reference near infrared ray quantity, a toner density in each developing unit can be held constant.

Figure 3:
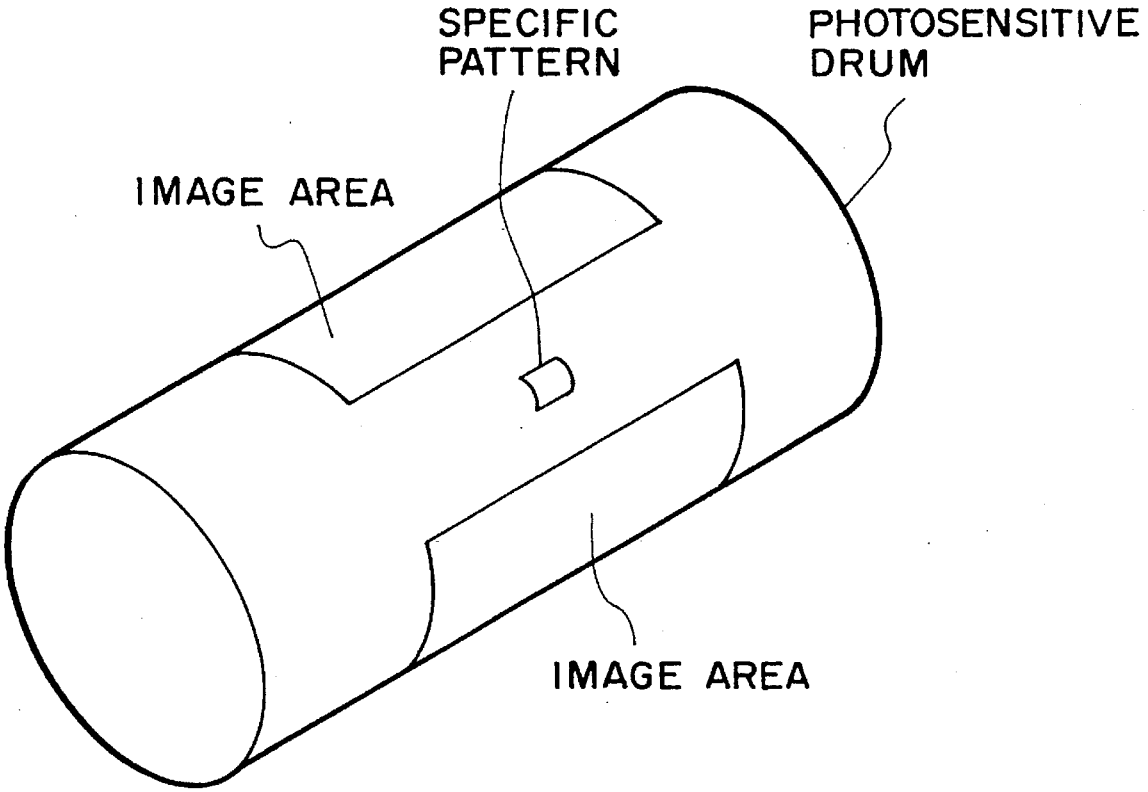
FIG. 3 is a diagram showing an example of a location to form a specific pattern patch.

Ordinarily, in the case of forming the specific pattern for the above purpose, it is desirable to form the specific pattern into a non-image area as shown in FIG. 3.

Figure 4:
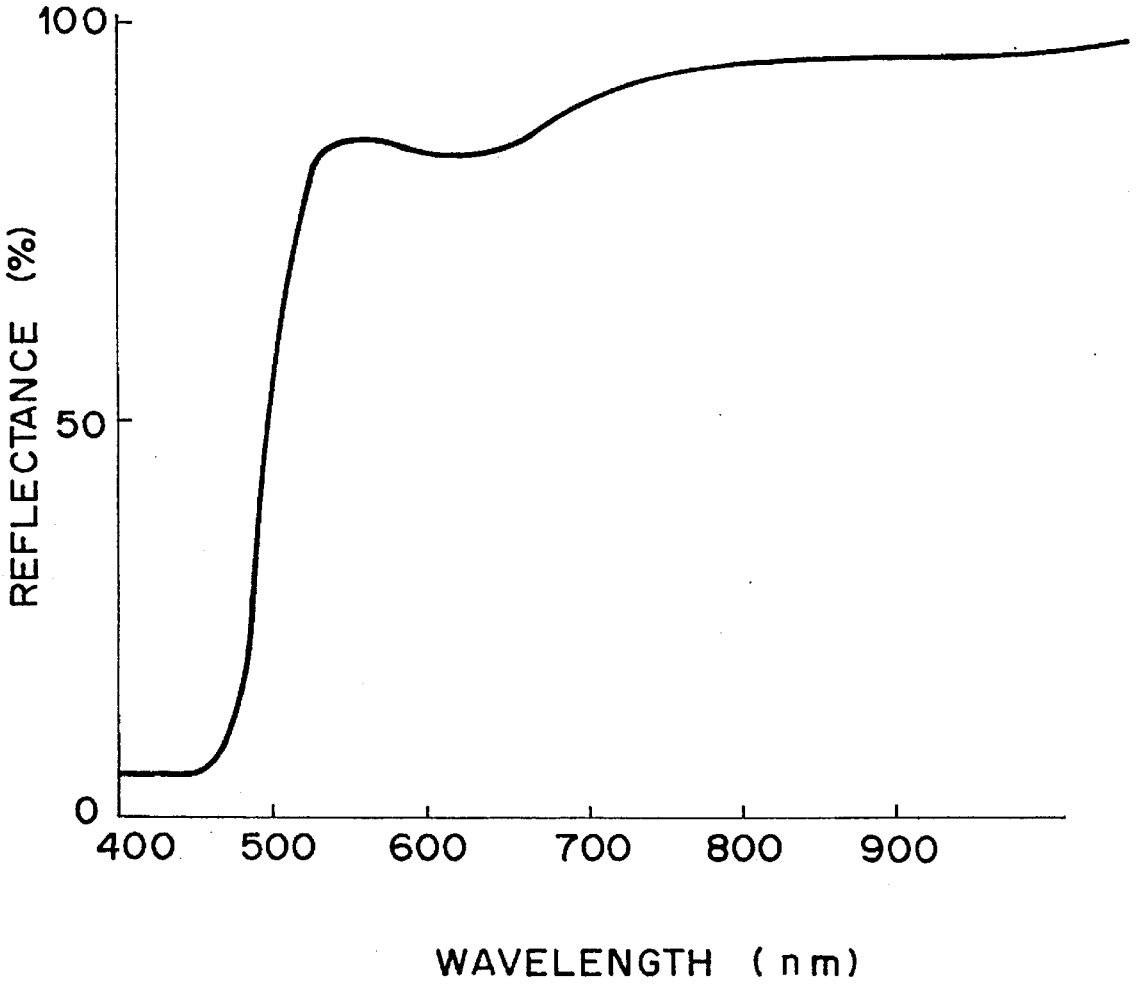
FIG. 4 is a diagram showing an example of yellow toner spectral characteristics.
Figure 5:
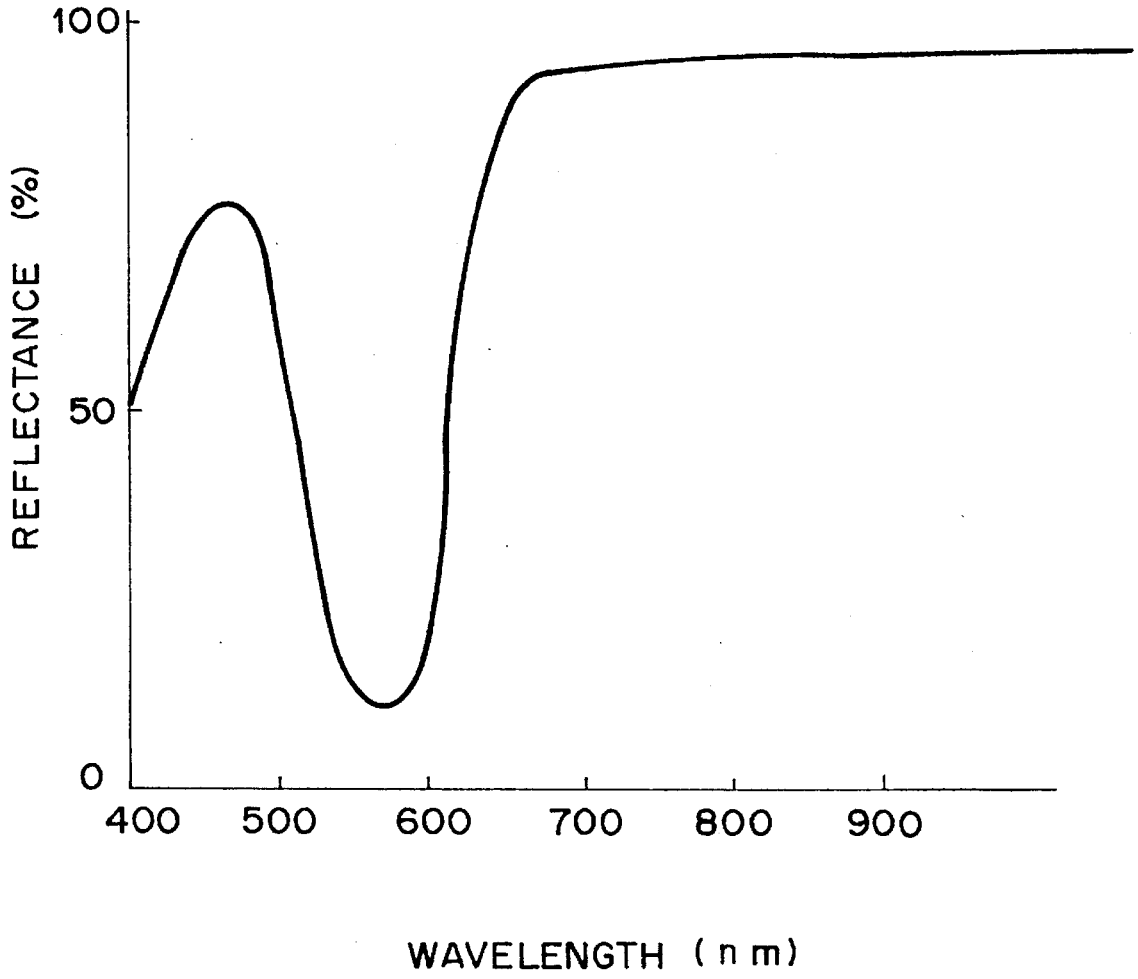
FIG. 5 is a diagram showing an example of magenta toner spectral characteristics.
Figure 6:
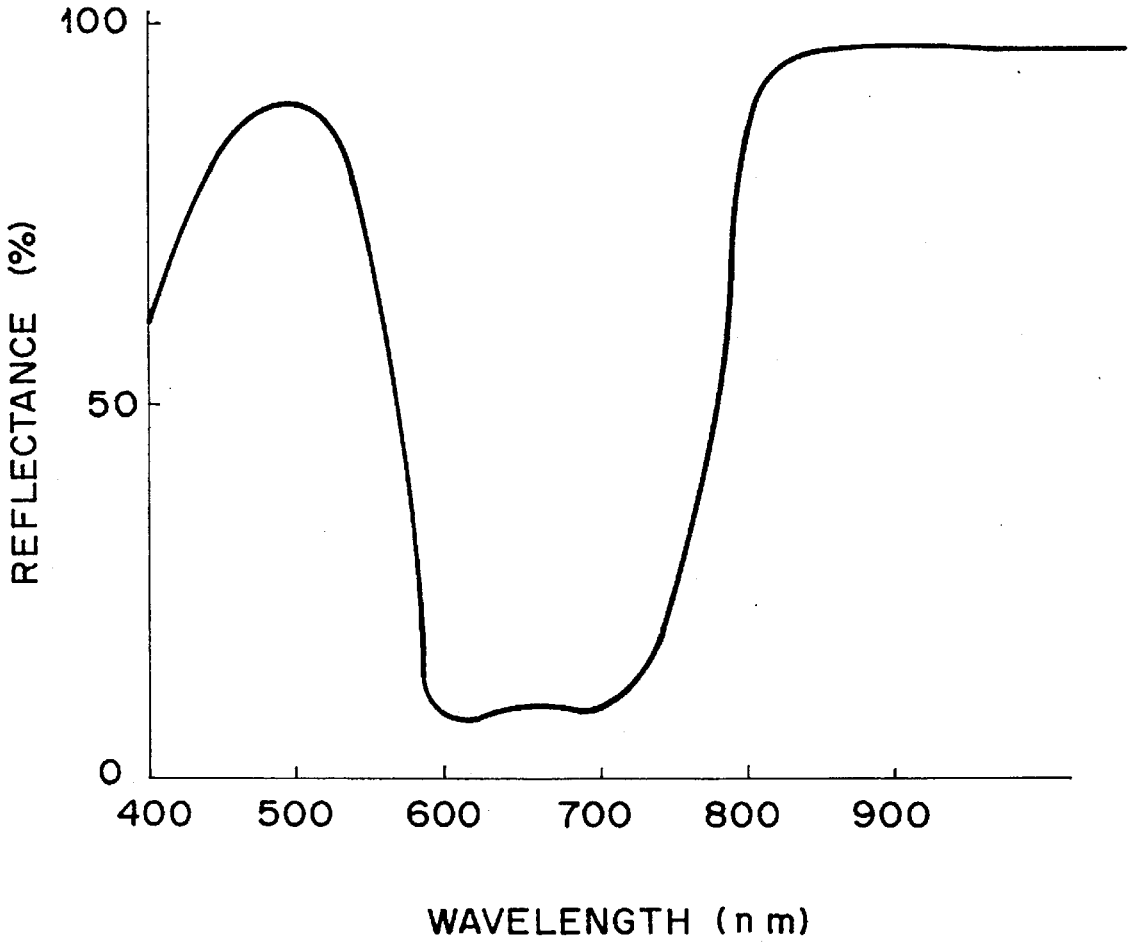
FIG. 6 is a diagram showing an example of cyan toner spectral characteristics.

Yellow, magenta, and cyan toners are used in the embodiment. A styrene system copolymer resin is used as a binder and a coloring material of each color is distributed, thereby forming each toner. The yellow, magenta, and cyan toners have spectral characteristics as shown in FIGS. 4 to 6 in accordance with the above order. A reflectance of 80% or more is obtained for the near infrared rays (960 nm). In the color toner image formation, a two-component developing system which is advantageous for the color purity and transmission performance is used. Further, the toners whose average grain diameter is set to a value within a range from 8 to 12 μm are used. Such toners are obtained by a well-known grinding method. It has been confirmed that the similar result is also obtained with respect to the polymerized color toner by another suspension polymerizing method.

Figure 7:
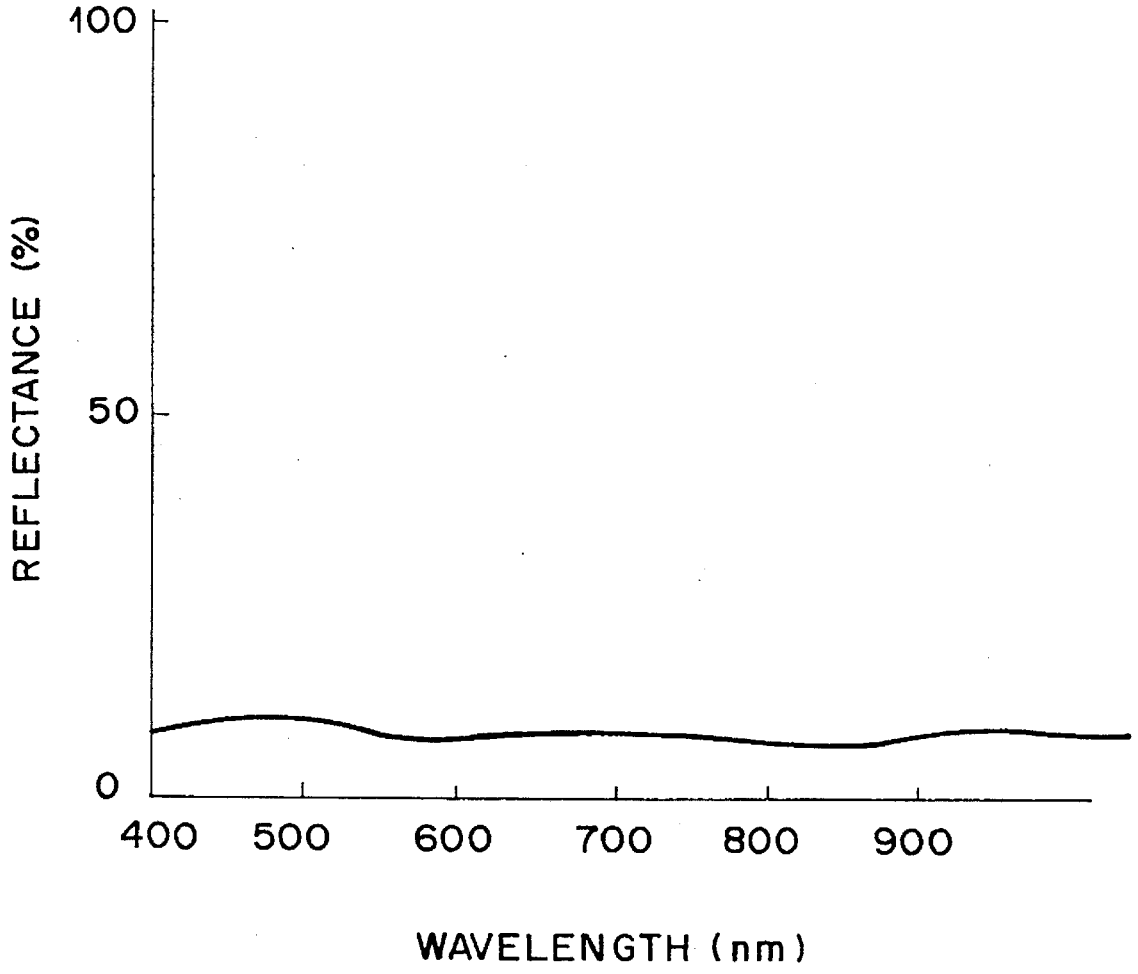
FIG. 7 is a diagram showing an example of black (one component magnetism) toner spectral characteristics.

On the other hand, a two-component black toner containing carbon is used as a black toner. As shown in FIG. 7, a reflectance of the near infrared rays (960 nm) is equal to about 10%. The average grain diameter, shape, and the like of the black toner are set to values similar to those of the color toners.

A reflectance of the photosensitive drum 1 for the light having a wavelength of 960 nm is set to about 40%. An OPC drum is used as a photosensitive drum 1.

Figure 8:
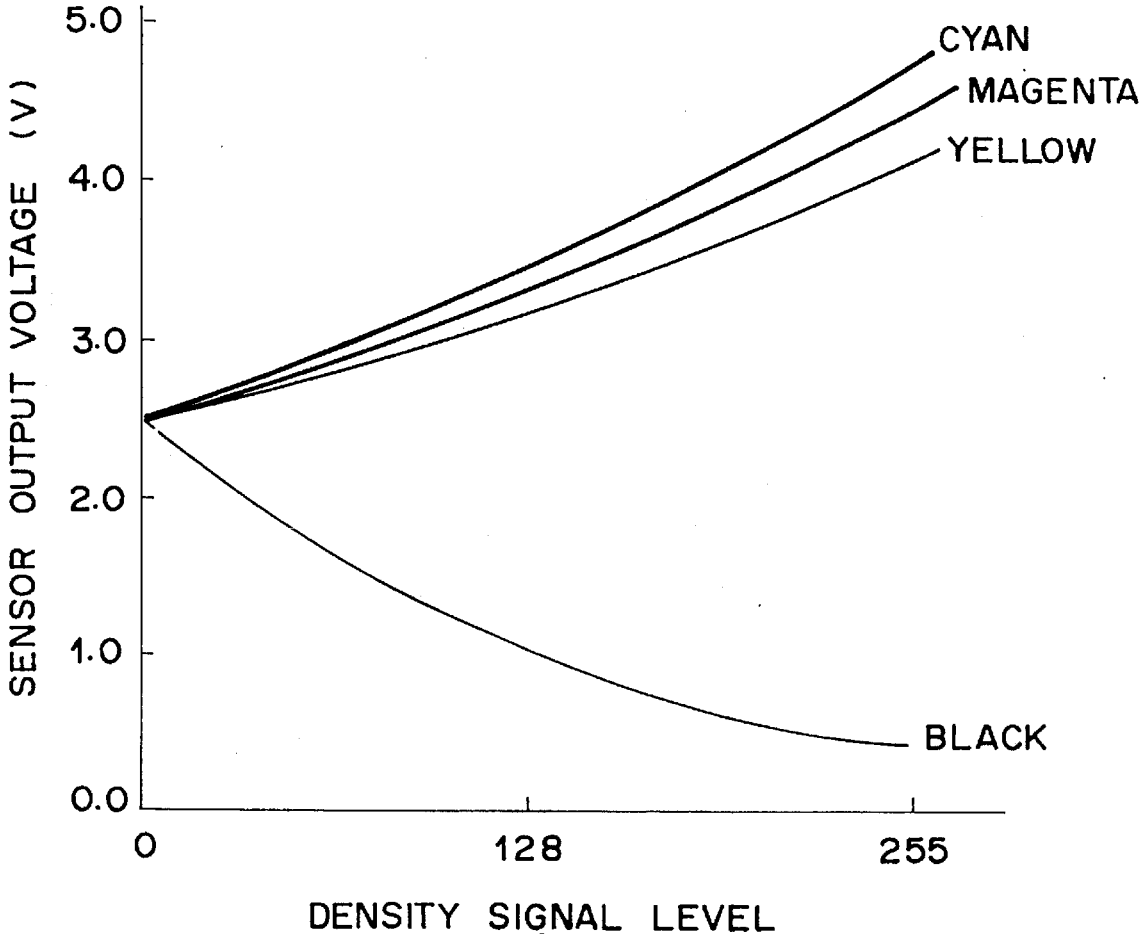
FIG. 8 is a diagram showing an example of a sensor output to a density signal level in the case of using near infrared rays.

FIG. 8 shows the relation between the density signal level and the output of the sensor 11*b*. A change in density signal level is obtained by changing the area gradation characteristics by the pulse width conversion of each color step by step in the case where the developing agent toner density is proper. The output of the sensor 11*b* in a state in which no toner is deposited on the photosensitive drum 1 is set to 2.5 V. As will be understood from FIG. 8, reflected light amounts of the color toners of yellow, magenta, and cyan increase as the image density signal level rises and the area coating ratio increases, so that the sensor output increases. On the other hand, the reflection light amount of the black toner decreases and the sensor output decreases as the density signal level rises.

By using the above relations, even in the case of the toners having different reflecting characteristics, a state of output image can be measured from the sensor output without copy transferring and fixing the toner onto a copy paper.

Figure 9:
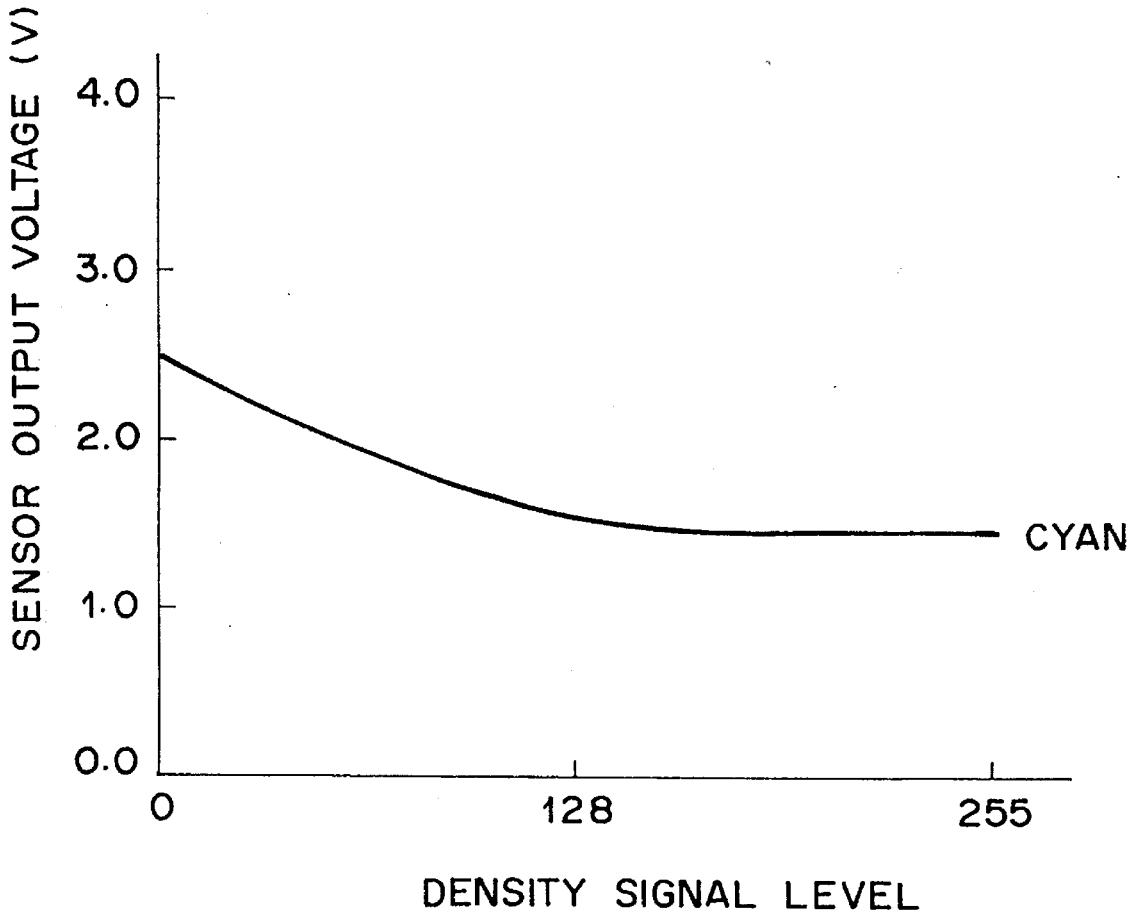
FIG. 9 is a diagram showing an example of a sensor output to a density signal level in the case of using visible rays.

The inventors have also monitored the sensor outputs through color separation filters by using a visible light source and examining the relations between the sensor outputs and the image densities. FIG. 9 shows the relation between the signal level and the sensor output with respect to the cyan toner in the case where the image density has been measured by allowing the visible rays to pass through a red color separation filter having a main wavelength of 600 nm. As will be understood from FIG. 9, in the region where an output density is equal to 1.0 or more, a change in sensor output is small and the accuracy regarding such an area is bad. This is because the gradation reproducing system in the embodiment is based on the area gradation system. However, it has actually been observed that the density changes in the direction of not only the area but also the thickness of the toner in the high density area.

According to the measurement by the visible rays, when one layer of the photosensitive drum is coated by the toner, the signal is saturated. On the other hand, in the case of the near infrared rays, since a transmission factor is better than that of the visible rays, the near infrared rays enter the multilayers of the toners and a saturation point of the signal is high. In addition, the near infrared light source advantageous because a wide width of the measuring range can be obtained.

Although a wavelength of the near infrared rays which are used is set to 960 nm in the embodiment, it is preferable that such a wavelength lies within a range from 800 nm to 2000 nm in dependence on the spectral characteristics of the toners and photosensitive material and the characteristics of various kinds of light sources and photosensitive devices.

Figure 10:
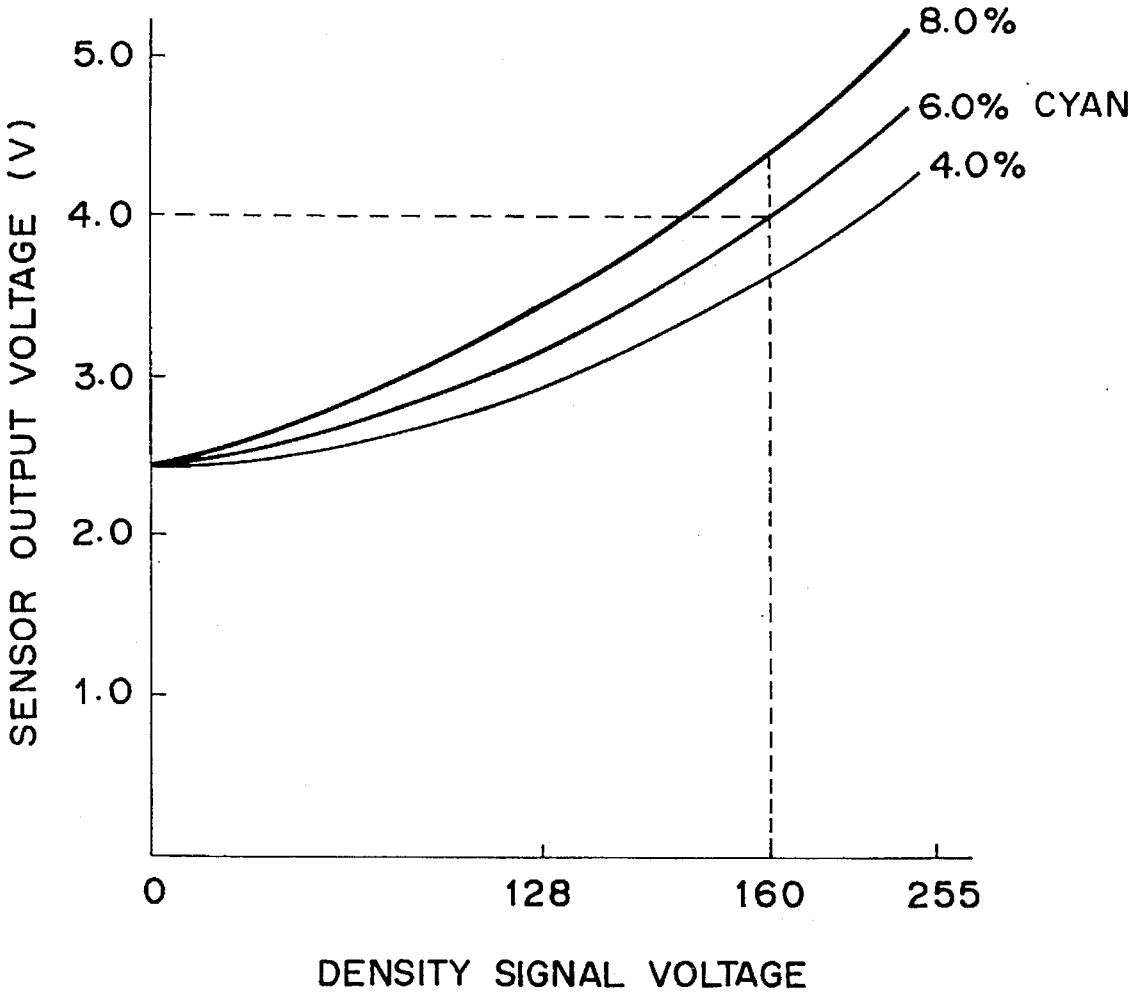
FIG. 10 is a diagram showing an example of a sensor output to a density signal level in the case of changing a toner density of a developing agent of a cyan toner.

FIG. 10 shows the relation between the density signal level and the output of the sensor 11*b* in the case where the developing agent toner density is changed with respect to cyan.

For the developing agent toner density of the cyan toner, a proper ratio of the toner/carrier at which the sufficient maximum image density is derived without causing a fog is set to 6.0%.

The above characteristics are set as standard characteristics of the printer in the embodiment.

Figure 11:
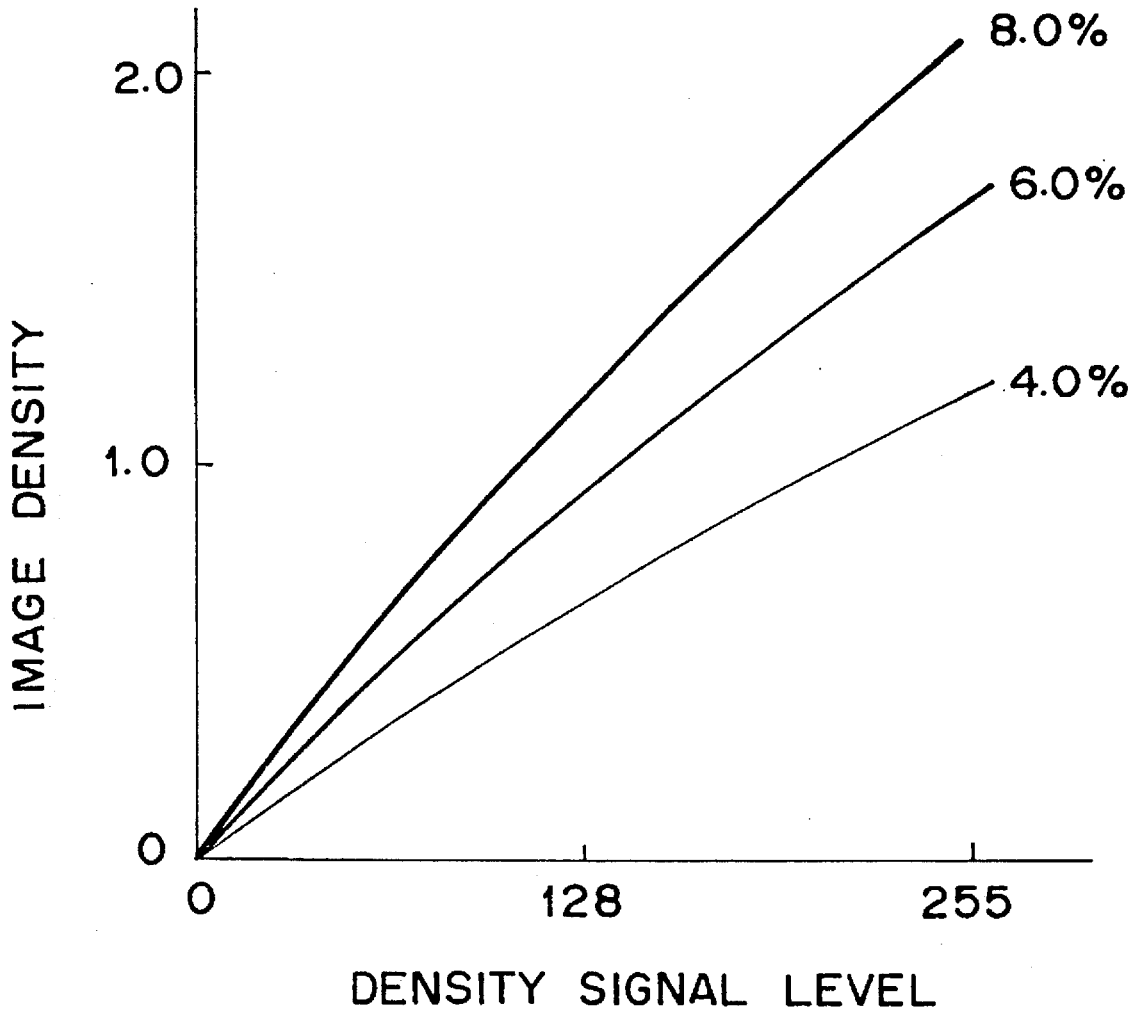
FIG. 11 is a diagram showing an example of an image density to a density signal level in the case of changing a toner density of a developing agent of the cyan toner.

On the other hand, it has been found out that when the developing agent toner density (toner/carrier) is changed to 4.0% and 8.0%, the characteristics change as shown in FIG. 11.

When the developing agent density is high, hard gradation characteristics are obtained. When the developing agent density is low, the soft gradation characteristics are derived. In the electrophotographic system, it is known that when a contrast voltage rises, a hard image is obtained, and when the contrast voltage is reduced, a soft image is derived.

Therefore, when considering the case of cyan, in the case where a pattern image whose density signal level is equal to 160 is formed onto the image carrier as a specific pattern and the sensor output level is higher than 4.0 V, an image of a hard tone and a higher maximum density than those of the standard characteristics is obtained. Therefore, in order to correct to the standard characteristics, an amount to reduce the contrast voltage is determined on the basis of the deviation amount from 4.0 V and such a contrast voltage is set, and thereafter, an image is formed.

When the output level of the sensor 11*b* is lower than 4.0 V, an amount to raise the contrast voltage is determined on the basis of the deviation amount from 4.0 V on the contrary and, thereafter, an image is formed.

In the invention, a combination of the density signal level and the sensor output at which a proper image can be obtained by one sensor has previously been stored into a memory with regard to each of cyan, magenta, yellow, and black. By executing the above control with respect to each color, the color balance and the maximum density can be stabilized.

Figure 12:
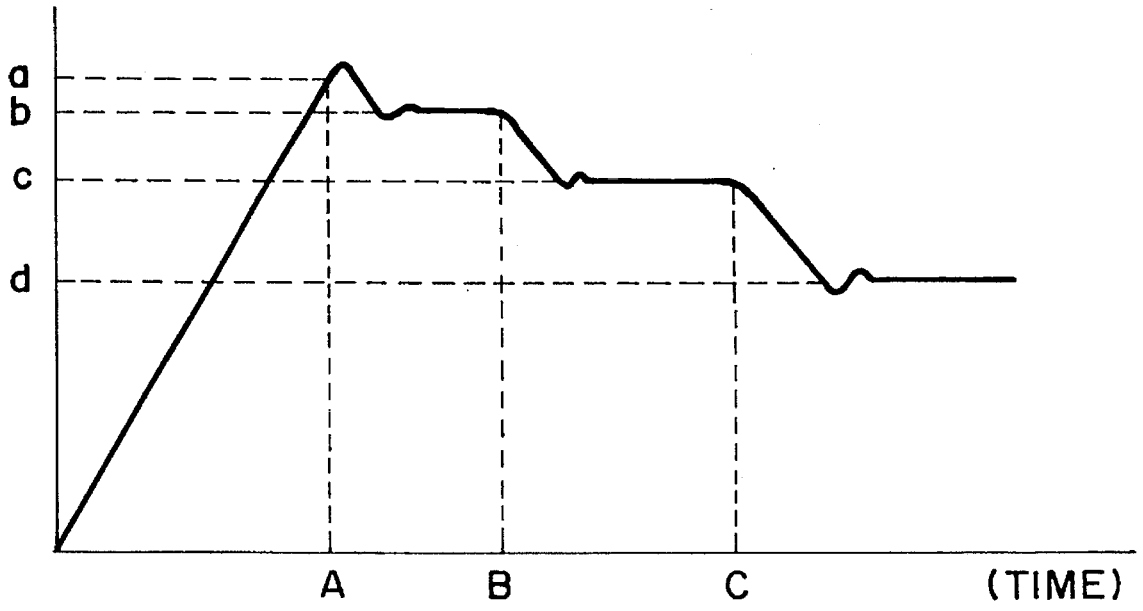
FIG. 12 is a diagram showing a preheating mode of a fixing roller temperature in the first embodiment.

Although it is desirable to execute the above control before the copying and printing-out operations are performed, it is extremely difficult to perform the control every time because it takes a long time. According to the embodiment, therefore, the above control is allowed to depend on the temperature of the fixing rollers of the fixing unit. FIG. 12 is a graph showing the preheating mode of the fixing unit. The temperature of the fixing unit reaches a set temperature a after the elapse of A hours from the turn-on of the power source. When the apparatus is left for a little while after that, the apparatus is set into the preheating mode and a set temperature of the fixing unit is set to b (the first preheating mode). The set temperature b is a temperature at which the copying operation can be performed soon. When the apparatus is further left for a period of time B-A, the set temperature of the fixing unit is set to c (the second preheating mode). The set temperature c is a temperature at which the apparatus can be reset to the copy enable state by merely waiting for a short time. When the apparatus is further left for a period of time C-B, the set temperature of the fixing unit is set to d (the third preheating mode) and a short time is required until the set temperature is returned to a copy enable temperature. a, b, c, d, A, B, and C have positive numbers and it is sufficient that they are suitable for the fixing apparatus.

In the state of the temperature c or less, a rest time of the machine is longer than that in the state within a range from a to b and there is a possibility such that the conditions decided by the image stabilizing control which has been executed at the initial stage are not sufficiently reflected. It is more preferable to again perform the feed-back operation.

The temperature c is used not only in the above preheating mode but also as a lower limit value of the temperature at which the machine can be recovered in a short time in the case where a door of the machine has been opened to process an abnormality such as a paper jam or the like and the power supply has been stopped. At a temperature which is equal to or higher than c, it is regarded that the initial control conditions can be adapted, so that the feedback operation is not performed even when the power source is again turned on. The temperature c is set so that the recovery time from degree c to degree a is equal to a time which is necessary for the feedback control. The feedback control is executed if the temperature of the fixing roller is less than c when the power source is turned on or the image formation command is inputted. Thus, the feedback control can be performed without obstructing the copying operation of the user and a good copy image can be derived. It has been found out from experiments that 90° C. is the optimum temperature as a temperature c.

That is, the temperature of the fixing unit at the time of turn-on of the power source is measured. When it is less than 90° C., the feedback control is executed in parallel with the heating operation of the heater 51. When it is 90° C. or higher, the feedback control is not executed.

Figure 13:
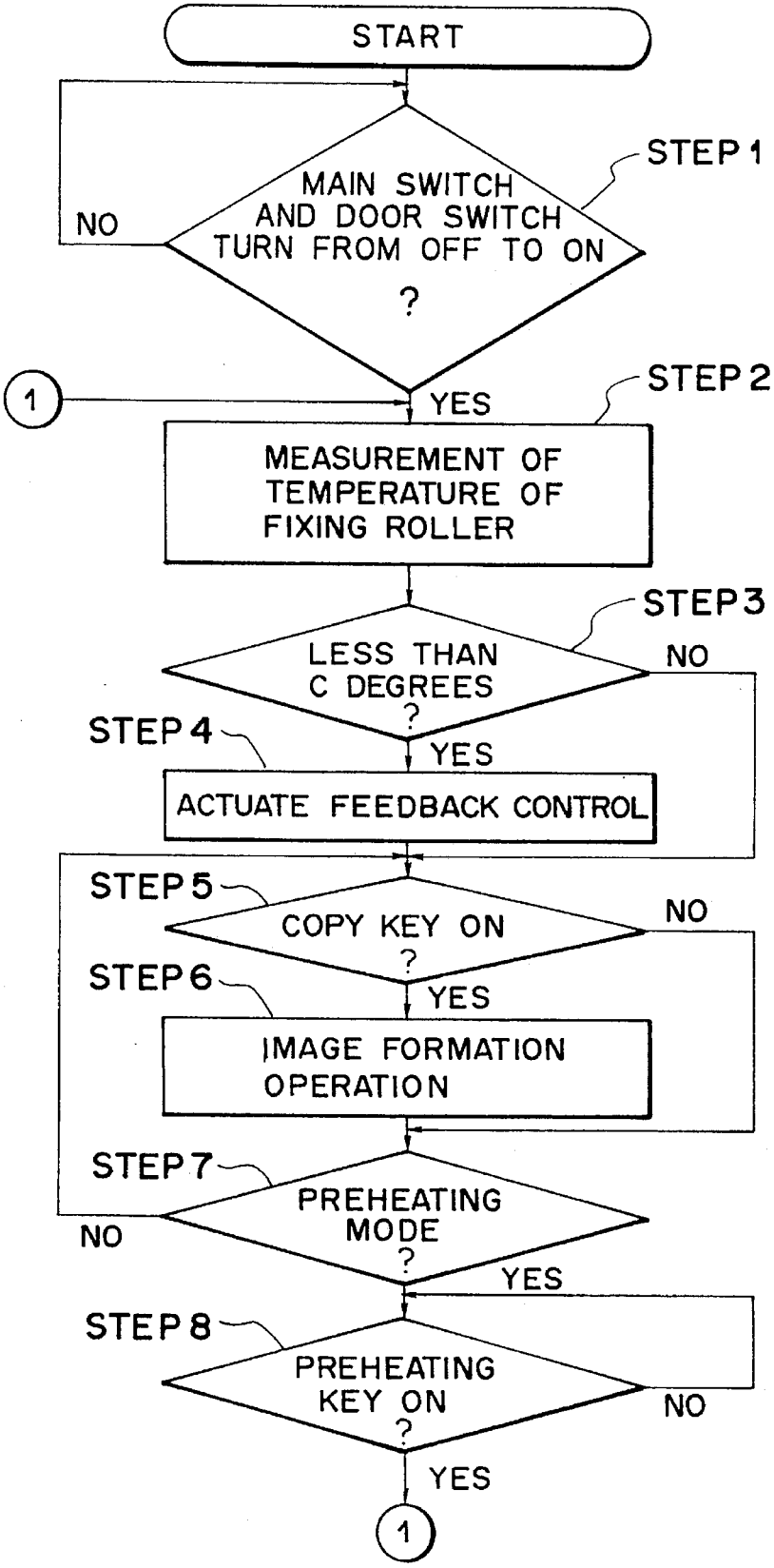
FIG. 13 is a flowchart showing the actuation of a feedback control.

FIG. 13 is a flowchart with respect to the actuation of the feedback control mentioned above.

A check is made to see if a main switch (power switch) or a door switch (a switch to detect the opening or closure of a door of a casing of the image forming apparatus: when the door is opened, the power supply to portions other than the control circuit is turned off) has been set to an ON state from an OFF state or not (step 1). When the door switch is turned on, the temperature of the fixing roller is measured (step 2). A check is made to see if the measured temperature is less than c degrees or not (step 3). When it is equal to or higher than c degrees, the feedback control is not performed. When the temperature of the fixing roller reaches the set temperature a, the apparatus waits for the input of a copy key. When the temperature of the fixing roller is less than c degrees, the feedback control is executed (step 4). When the temperature of the fixing roller is equal to the set temperature a, the apparatus waits for the input of a copy key (step 5). When the copy key is not turned on, a check is made to see if the preheating mode (the third preheating mode) has been set or not (step 7). In the case where the state in which the image forming apparatus is not used for a predetermined time has continued and in the case where a preheating key (not shown; this may serve as key input means) is depressed, the third preheating mode is set. When the copy key is depressed, the image forming operation is executed (step 6). After completion of the image formation, a check is made to see if the preheating mode has been set or not. When the preheating key is depressed in the preheating mode (step 9), the preheating mode is released and the processes in step 2 and subsequent steps are repeated.

Second Embodiment

In the case where the feedback control operation has been performed at a temperature less than c in the second preheating mode as in the above embodiment, there is a fear such that the durability of each part deteriorates and the life becomes short. Therefore, in the second embodiment, a temperature c' is set as a third preheating mode (c>c').

Figure 14:
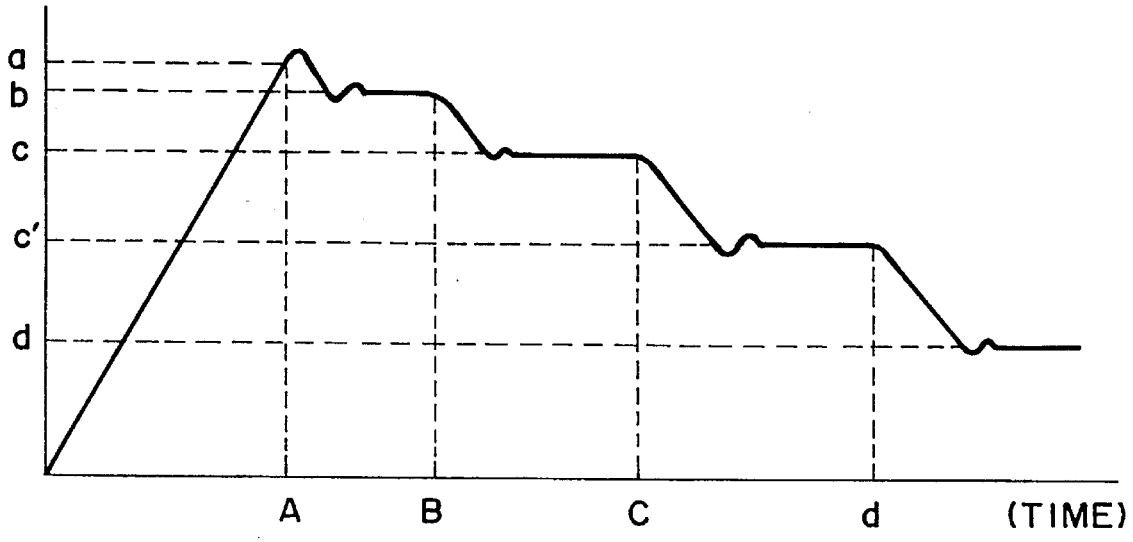
FIG. 14 is a diagram showing the preheating mode of the fixing roller temperature in the second embodiment.

FIG. 14 is a graph showing the preheating mode of the fixing unit. The temperature of the fixing unit reaches the set temperature a after the elapse of a time A from the turn-on of the power source. When the apparatus is left for a little while after that, the apparatus is set into the preheating mode and the set temperature of the fixing unit is set to b (the first preheating mode). The set temperature b is a temperature at which the copying operation can be soon performed. When the apparatus is further left for a period of time B-A. the set temperature of the fixing unit is set into c (the second preheating mode).

When the apparatus is further left for a period of time C-B, the set temperature of the fixing unit is set to c' (the third preheating mode). When the apparatus is further left for a period of time D-C, the set temperature of the fixing unit is set to d (the fourth preheating mode). a, b, c, c', d, A, B, C, and D are positive numbers and it is sufficient that they are suitable for the fixing apparatus.

By setting the temperature at which the feedback control operation is actuated to the fixing roller temperature c' or less, the number of feedback control operation times is reduced into the half and the life of each part can be extended than that in the first embodiment. An effect by the feedback control can be also similarly obtained.

It is desirable that the fixing roller temperature c' lies within a range from 90° to 70° C.

As described above, by allowing the actuation timing of the image stabilizing control operation to depend on the temperature of the load which is heated and controlled, the image forming operation can be smoothly executed without obstructing the image forming operation of the user. A good image can be derived.

The rest time of the machine can be known by the temperature of the load, the image stabilizing control can be properly performed, and a stable image can be always obtained.

In addition to a method of controlling the actuation of the feedback control by the temperature of the fixing roller, it is also possible to use another method whereby an elapsed time from the turn-on of the power source is measured and the number of image forming operation times is counted by a microcomputer and those data are stored into a memory which is backed up by a battery or the like and the actuation of the feedback control is controlled on the basis of those data.

What is claimed is:

1. An image forming apparatus comprising:

image forming means for forming an image onto a recording medium;

a control circuit for controlling operation of said image forming apparatus;

a power supply switch for supplying power to said image forming means and to said control circuit when said power supply switch is turned on;

a switch, responsive to a position of a door attached to a housing of said image forming apparatus, for permitting power to be supplied to the control circuit regardless of the position of the door, and for cutting off the supply of power to said image forming means when said door is open;

measuring means for measuring a density of the image formed on the recording medium;

heating means for heating a load by a power supply to the image forming apparatus;

detecting means for detecting a temperature of the load which is heated by the heating means, wherein the control circuit executes an image stabilizing control to determine image forming conditions of the image forming means on the basis of the image density measured by the measuring means, and wherein said control circuit controls execution of the image stabilizing control in accordance with an output of the detecting means either when said power supply switch supplies power to said image forming means or when said switch responds to a closed position of the door.

2. An apparatus according to claim 1, wherein the control means executes the image stabilizing control when the temperature detected by the detecting means is less than a predetermined value, and said control means doesn't execute the image stabilizing control when said temperature is equal to or higher than the predetermined value.

3. An apparatus according to claim 1, wherein when the image stabilizing control is executed, said control means allows the image forming means to form a specific image.

4. An apparatus according to claim 3, wherein said image forming means has generating means for generating data indicative of said specific image.

5. A color image forming apparatus comprising:

image forming means for forming a color image onto a recording medium by using coloring agents of a plurality of colors;

a control circuit for controlling operation of said image forming apparatus;

a power supply switch for supplying power to said image forming means and to said control circuit when said power supply switch is turned on;

a switch, responsive to a position of a door attached to a housing of said image forming apparatus, for permitting power to be supplied to said control circuit regardless of the position of said door, and for cutting off the supply of power to said image forming means when said door is in an open state;

measuring means for measuring a density of an image of each color which is formed on the recording medium;

heating means for heating a load by a power supply to the image forming apparatus;

detecting means for detecting a temperature of the load which is heated by the heating means, wherein said control circuit executes an image stabilizing control to determine image forming conditions of each color of said image forming means on the basis of the density of the image of each color which has been measured by said measuring means, and wherein said control circuit controls execution of the image stabilizing control in accordance with an output of said detecting means either when said power supply switch supplies power to said image forming means or when said switch responds to a closed position of the door.

6. An apparatus according to claim 5, wherein said image forming means sequentially forms the image by depositing respective coloring agents in accordance with a predetermined order.

7. An apparatus according to claim 5, wherein the control means executes the image stabilizing control when the temperature detected by the detecting means is less than a predetermined value, and said control means doesn't execute the image stabilizing control when said temperature is equal to or higher than the predetermined value.

8. An image forming apparatus comprising:

image forming means for forming an image onto a recording medium;

measuring means for measuring a density of the image formed on the recording medium;

heating means for heating a load of a portion of said image forming means to a predetermined temperature by power supplied to said image forming apparatus;

heat control means for controlling said heating means so that the temperature of said load is reduced to save power consumption of said image forming apparatus when said image forming apparatus does not form the image;

key input means for inputting an instruction to reheat said load at the predetermined temperature when the temperature of said load is reduced by said heat control means;

detecting means for detecting the temperature of said load; and control means for executing an image stabilizing control to determine image forming conditions of said image forming means according to the density measured by said measuring means, wherein said control means controls execution of the image stabilizing control according to an output provided by said detection means when the instruction is inputted by said key input means.

9. An image forming apparatus according to claim 8, wherein said control means controls said heat control means so that the temperature of said load is reduced when an image forming operation is not executed for a predetermined time.

10. An image forming apparatus according to claim 8, wherein said heat control means controls said heating means so that the temperature of said load is reduced when the temperature of said load is the predetermined temperature and the instruction is inputted by said key input means.

11. An image forming apparatus according to claim 8, wherein the control means executes image stabilizing control when the temperature detected by the detection means is less than a predetermined value, and wherein said control means does not execute the image stabilizing control when said temperature is equal to or higher than the predetermined value.

12. An image apparatus according to claim 8, wherein said control means further controls execution of the image stabilizing control according to an output provided by said detection means when power is supplied to said image forming apparatus.

13. An image forming apparatus according to claim 8, wherein in the case the image stabilizing control is executed, said control means allows the image forming means to form a specific image.

14. An image forming apparatus according to claim 13, wherein said image forming means has generating means for generating data indicative of said specific image.

15. An image forming apparatus comprising:

image forming means for forming a color image on a recording medium by using at least one coloring agent of a plurality of coloring agents;

measuring means for measuring a density of an image of each coloring agent which is formed on the recording medium;

heating means for heating a load of a portion of said image forming means at a predetermined temperature by power supplied to said image forming apparatus;

heat control means for controlling said heating means so that the temperature of said load is reduced to save power consumption of said image forming apparatus when said image forming apparatus does not form the image;

key input means for inputting a command to reheat said load to the predetermined temperature when the temperature of said load is reduced by said heat control means;

detection means for detecting the temperature of said load; and control means for executing an image stabilizing control to determine image forming conditions of the image of each coloring agent of said image forming means according to the density of the image of each coloring agent measured by said measuring means, wherein said control means controls execution of the image stabilizing control according to an output provided by said detection means when the command to reheat is inputted by said key input means.

16. An image forming apparatus according to claim 15, wherein said control means controls said heat control means so that the temperature of said load is reduced when an image forming operation is not executed for a predetermined time.

17. An image forming apparatus according to claim 15, wherein said heat control means controls said heating means so that the temperature of said load is reduced when the temperature of said load is the predetermined temperature and the instruction is inputted by said key input means.

18. An image forming apparatus according to claim 15, wherein said image forming means sequentially forms the images from respective coloring agents in accordance with a predetermined order.

19. An image forming apparatus according to claim 15, wherein the control means executes the image stabilizing control when the temperature detected by said detecting means is less than a predetermined value, and said control means does not execute the image stabilizing control when said temperature is equal to or higher than the predetermined value.

20. An image forming apparatus comprising:

image forming means for forming an image onto a recording medium;

a switch, responsive to a position of a door attached to a housing of said image forming apparatus, for cutting off a supply of power to said image forming means when said door is open;

a control circuit for controlling operation of said image forming apparatus;

measuring means for measuring a density of the image formed on the recording medium;

heating means for heating a load by a power supply to the image forming apparatus;

detecting means for detecting a temperature of the load which is heated by the heating means, wherein the control circuit executes an image stabilizing control to determine image forming conditions of the image forming means on the basis of the image density measured by the measuring means, and wherein said control circuit controls execution of the image stabilizing control in accordance with an output of the detecting means when said switch responds to a closed position of the door.

21. An apparatus according to claim 20, wherein the control circuit executes the image stabilizing control when the temperature detected by the detecting means is less than a predetermined value, and said control circuit does not execute the image stabilizing control when said temperature is equal to or higher than the predetermined value.

22. An apparatus according to claim 20, wherein said control circuit performs said image stabilizing control operation in which said image forming means is caused to form a pattern image onto a photosensitive member on the basis of a digital image signal having a predetermined density level, said measuring means is caused to measure density of said pattern image and a contrast voltage of a latent image to be formed onto the photosensitive member is determined on the basis of the result of measurement by said measuring means.

23. A color image forming apparatus comprising:

image forming means for forming a color image onto a recording medium by using coloring agents of a plurality of colors;

a control circuit for controlling operation of said image forming apparatus;

a switch, responsive to a position of a door attached to a housing of said image forming apparatus for cutting off a supply of power to said image forming means when said door is in an open state;

measuring means for measuring a density of an image of each color which is formed on the recording medium;

heating means for heating a load by a power supply to the image forming apparatus;

detecting means for detecting a temperature of the load which is heated by the heating means, wherein the control circuit executes an image stabilizing control to determine image forming conditions of each color of said image forming means on the basis of the density of the image of each color which has been measured by the measuring means, and wherein said control circuit controls execution of the image stabilizing control in accordance with an output of said detecting means when said switch responds to a closed position of the door.

24. An apparatus according to claim 23, wherein said image forming means sequentially forms the image by depositing respective coloring agents in accordance with a predetermined order.

25. An apparatus according to claim 23, wherein the control circuit executes the image stabilizing control when the temperature detected by the detecting means is less than a predetermined value, and said control means does not execute the image stabilizing control when said temperature is equal to or higher than the predetermined value.

26. An apparatus according to claim 23, wherein said measuring means further comprises a common sensor for measuring the density of the pattern image of each coloring agent.

27. An apparatus according to claim 23, wherein said control circuit performs said image stabilizing control operation in which said image forming means is caused to form a pattern image of each coloring agent onto a photosensitive member on the basis of a digital image signal having a predetermined density level of each color, said measuring means is caused to measure density of the pattern image of each coloring agent and a contrast voltage of a latent image of each color, to be formed onto the photosensitive member, is determined on the basis of the result of measurement by said measuring means.

28. An image forming apparatus comprising:

image forming means for forming an image onto a recording medium;

a power supply switch for supplying power to said image forming means when said power supply switch is turned on;

a switch, responsive to a position of a door attached to a housing of said image forming apparatus, for cutting off the supply of power to said image forming means when said door is open;

a control circuit for controlling operation of said image forming apparatus;

measuring means for measuring a density of the image formed on the recording medium;

heating means for heating a load by a power supply to the image forming apparatus;

detecting means for detecting a temperature of the load which is heated by the heating means, wherein the control circuit executes an image stabilizing control to determine image forming conditions of the image forming means on the basis of the image density measured by the measuring means, and wherein said control circuit controls execution of the image stabilizing control in accordance with an output of the detecting means either when said power supply switch supplies power to said image forming means or when said switch responds to a closed position of the door.

29. An apparatus according to claim 28, wherein the control circuit executes the image stabilizing control when the temperature detected by the detecting means is less than a predetermined value, and said control circuit does not execute the image stabilizing control when said temperature is equal to or higher than the predetermined value.

30. An apparatus according to claim 28, wherein when the image stabilizing control is executed, said control circuit allows the image forming means to form a specific image.

31. An apparatus according to claim 30, wherein said image forming means has generating means for generating data indicative of said specific image.

32. A color image forming apparatus comprising:

image forming means for forming an image onto a recording medium by using coloring agents of a plurality of colors;

a power supply switch for supplying power to said image forming means when said power supply switch is turned on;

a switch, responsive to a position of a door attached to a housing of said image forming apparatus, for cutting off the supply of power to said image forming means when said door is open;

a control circuit for controlling operation of said image forming apparatus;

measuring means for measuring a density of the image formed on the recording medium;

heating means for heating a load by a power supply to the image forming apparatus;

detecting means for detecting a temperature of the load which is heated by the heating means, wherein the control circuit executes an image stabilizing control to determine image forming conditions of each color of said image forming means on the basis of the image density of the image of each color which has been measured by the measuring means, and wherein said control circuit controls execution of the image stabilizing control in accordance with an output of the detecting means either when said power supply switch supplies power to said image forming means or when said switch responds to a closed position of the door.

33. An apparatus according to claim 32, wherein said image forming means sequentially forms the image by depositing respective coloring agents in accordance with a predetermined order.

34. An apparatus according to claim 32, wherein the control circuit executes the image stabilizing control when the temperature detected by the detecting means is less than a predetermined value, and said control circuit does not execute the image stabilizing control when said temperature is equal to or higher than the predetermined value.

35. An apparatus according to claim 32, wherein said measuring means further comprises a common sensor for measuring a density of a pattern image of each coloring agent.

* * * * *